US006167830B1

(12) United States Patent
Pilger

(10) Patent No.: US 6,167,830 B1
(45) Date of Patent: Jan. 2, 2001

(54) BOAT TRIM TABS

(76) Inventor: Don T. Pilger, 1263 Silverwood Rd., Woodbury, MN (US) 55125

( * ) Notice: Under 35 U.S.C. 154(b), the term of this patent shall be extended for 0 days.

(21) Appl. No.: 09/454,750

(22) Filed: Dec. 6, 1999

(51) Int. Cl.[7] ..... B63B 1/22
(52) U.S. Cl. ..... 114/285
(58) Field of Search ..... 114/271, 274, 114/284, 285, 286, 287

(56) References Cited

U.S. PATENT DOCUMENTS

| | | | | |
|---|---|---|---|---|
| D. 292,392 | | 10/1987 | Zepp . | |
| D. 386,465 | | 11/1997 | Bachmann . | |
| 3,568,618 | | 3/1971 | Bedford . | |
| 3,577,948 | | 5/1971 | Frey . | |
| 3,601,078 | | 8/1971 | Bedford . | |
| 3,604,383 | | 9/1971 | Ingleman . | |
| 3,628,484 | | 12/1971 | Banner . | |
| 3,628,486 | | 12/1971 | Bennett . | |
| 3,650,310 | | 3/1972 | Childress . | |
| 3,695,204 | | 10/1972 | Bennett . | |
| 3,705,519 | | 12/1972 | Sjoo . | |
| 3,760,758 | * | 9/1973 | Banner | 114/285 |
| 3,769,927 | | 11/1973 | Carney . | |
| 3,783,817 | | 1/1974 | Banner . | |
| 3,814,044 | | 6/1974 | Kercheval . | |
| 3,977,349 | | 8/1976 | Hummel . | |
| 3,980,035 | | 9/1976 | Johansson . | |
| 4,323,027 | | 4/1982 | Schermerhorn . | |
| 4,327,657 | | 5/1982 | Knoos . | |
| 4,500,298 | | 2/1985 | Hall . | |
| 4,597,742 | | 7/1986 | Finkl . | |
| 4,708,672 | | 11/1987 | Bentz . | |
| 4,742,794 | | 5/1988 | Hagstrom . | |
| 4,854,259 | | 8/1989 | Cluett . | |
| 4,967,682 | | 11/1990 | O'Donnell . | |
| 5,113,780 | | 5/1992 | Bennett . | |
| 5,315,951 | | 5/1994 | Finkl . | |
| 5,340,345 | | 8/1994 | Brodbeck . | |
| 5,385,110 | | 1/1995 | Bennett . | |
| 5,443,026 | | 8/1995 | Wenstadt . | |
| 5,474,012 | | 12/1995 | Yamada . | |
| 5,800,221 | | 9/1998 | Dombrowski . | |
| 5,878,686 | * | 3/1999 | Anderson | 114/285 |

* cited by examiner

*Primary Examiner*—Stephen Avila
(74) *Attorney, Agent, or Firm*—Gerald E. Helget; Rider, Bennett, Egan & Arundel

(57) ABSTRACT

A manual trim tab for a power boat having a transom at the stern includes: a first bracket adapted to be mounted to the boat's transom near the surface of the water, the first bracket further having a first portion for mounting to the transom, a second portion extending downwardly from the first portion, and a third portion having a shelf, the shelf being substantially perpendicular to the first portion; a trim plate pivotally mounted on the first bracket by a lip pivotally engaging the shelf; a second bracket adapted to be mounted to the boat's transom above the first bracket; a lower adjustment rod pivotally mounted to the trim plate; an upper adjustment rod pivotally mounted to the second bracket and slidingly engaging the lower adjustment rod, thereby varying the angle at which the trim plate meets the watcr's surface; and a locking mechanism for preventing movement of the upper adjustment rod relative to the lower adjustment rod.

15 Claims, 3 Drawing Sheets

BOAT TRIM TABS

BACKGROUND OF THE INVENTION

The present invention relates to a trim tab for a power boat. Trim tabs for boats have been provided that operate in various ways and are mounted in various ways on the stem of the boat. One type comprises a rigid bracket secured to the stem or transom of the boat which has a flexible plate mounted on it and means for flexing the plate to adjust the same to various angular positions relative to the bracket. This does not provide the desired amount of adjustability and involves the use of a large number of unnecessary parts in order to get the desired adjustment of the flexible plate.

Some devices are extremely complex, comprising considerable electrical apparatus to operate them, including solenoid valves, operating means for the solenoid valves and fluid cylinders for adjusting the position of the tabs. Others comprise hand wheel operated threaded shafts that are threadably mounted in a socket and connected with the plates by a link that has special fittings or connecting it with the shaft and a bracket on the tab plate. Still others have connections in which ball and socket joints and other expensive parts are used. Others have plates that are adjusted by means of electrical motors that are controlled by the boat operator or automatically.

All trim tabs operate on the same basic principle. As a power boat accelerates, the bow rises. A trim tab operates to raise the stem (and thus lower the bow) by the well-known Bernoulli effect of a fluid rushing over a plane inclined relative to the path of motion. As the angle at which the trim tab enters the water increases, the lift on the trim tab also increases, thus raising the stem. Leveling the boat in this manner produces maximum speed and efficiency by lowering the fuel consumption, reducing the load upon the engine, and producing a smoother ride.

There is a need for a simple trim tab for small power boats that fulfills the basic function of raising the stem while minimizing the complexity of the device.

SUMMARY OF THE INVENTION

A manual trim tab for a power boat having a transom at the stern includes: a first bracket adapted to be mounted to the boat's transom near the surface of the water, the first bracket further having a first portion for mounting to the transom, a second portion extending downwardly from the first portion, and a third portion having a shelf, the shelf being substantially perpendicular to the first portion; a trim plate pivotally mounted on the first bracket by a lip pivotally engaging the shelf; a second bracket adapted to be mounted to the boat's transom above the first bracket; a lower adjustment rod pivotally mounted to the trim plate; an upper adjustment rod pivotally mounted to the second bracket and slidingly engaging the lower adjustment rod, thereby varying the angle at which the trim plate meets the water's surface; and a locking mechanism for preventing movement of the upper adjustment rod relative to the lower adjustment rod.

A principle object and advantage of the present invention is that is made from very simple parts that are readily available, thus reducing the cost of manufacture.

A second object and advantage of the present invention is that it does not have complicated adjusting or locking mechanisms, thus increasing its reliability.

Another principle object and advantage of the present invention is that it is entirely mechanical and does not need electrical power to operate.

These and other objects of the present invention will become readily apparent upon further review of the following specification and drawings.

BRIEF DESCRIPTION OF THE DRAWINGS

FIG. 2 is a left elevational view of the manual trim tab of the present invention.

Similar reference characters denote corresponding features consistently throughout the attached drawings.

DETAILED DESCRIPTION OF THE PREFERRED EMBODIMENTS

Figure 1:
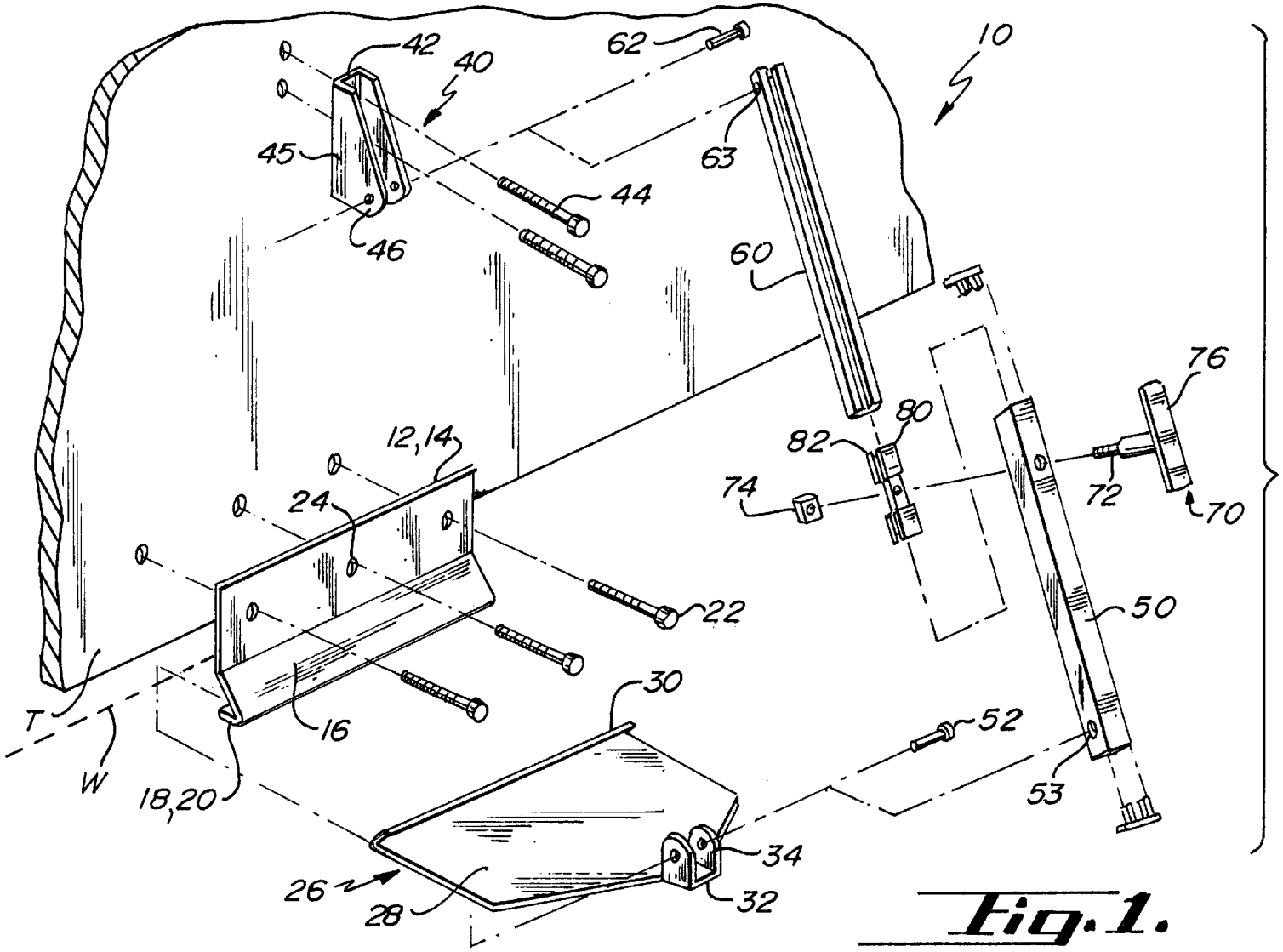
FIG. 1 is an exploded view of the manual trim tab of the present invention.
Figure 3:
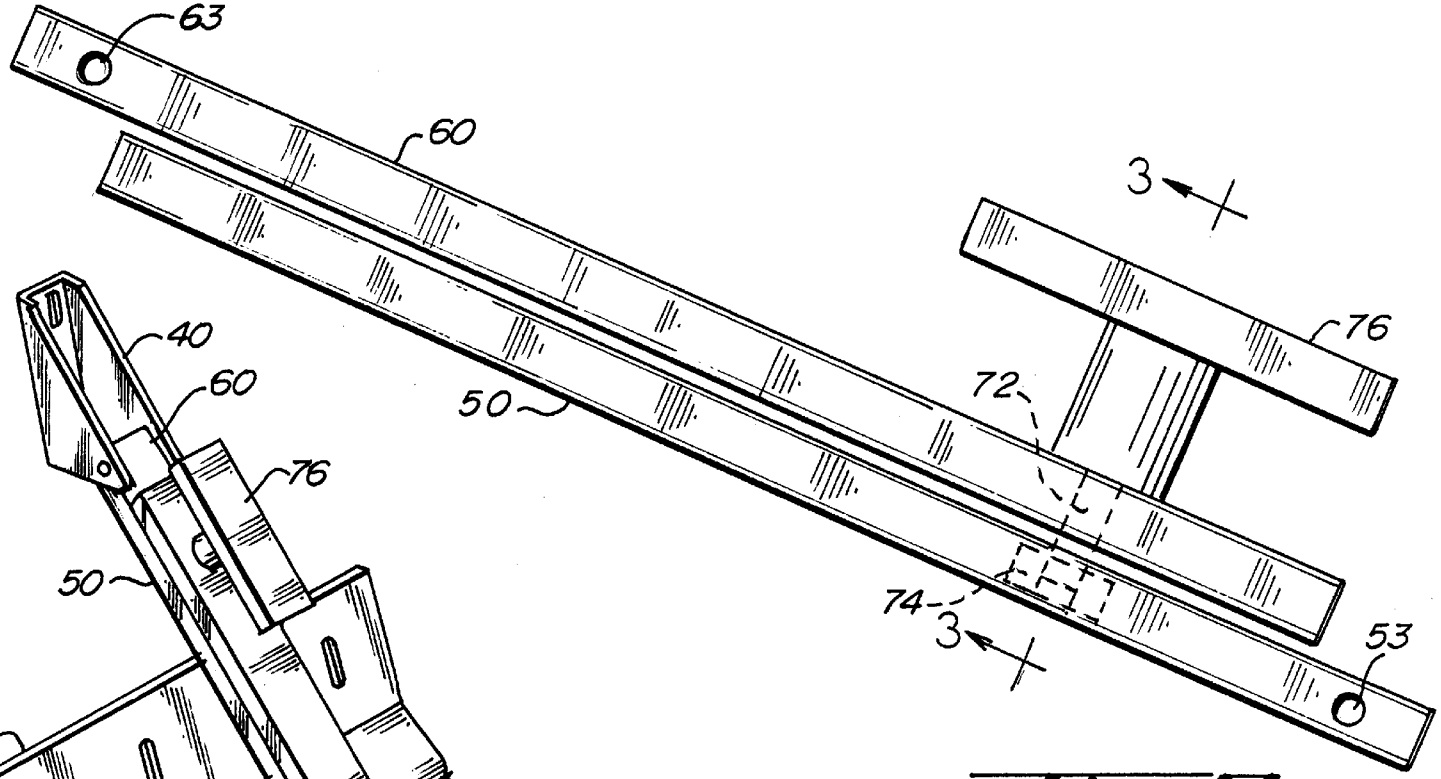
FIG. 3 is a cross-section along the lines 3 of FIG. 2.
Figure 4:
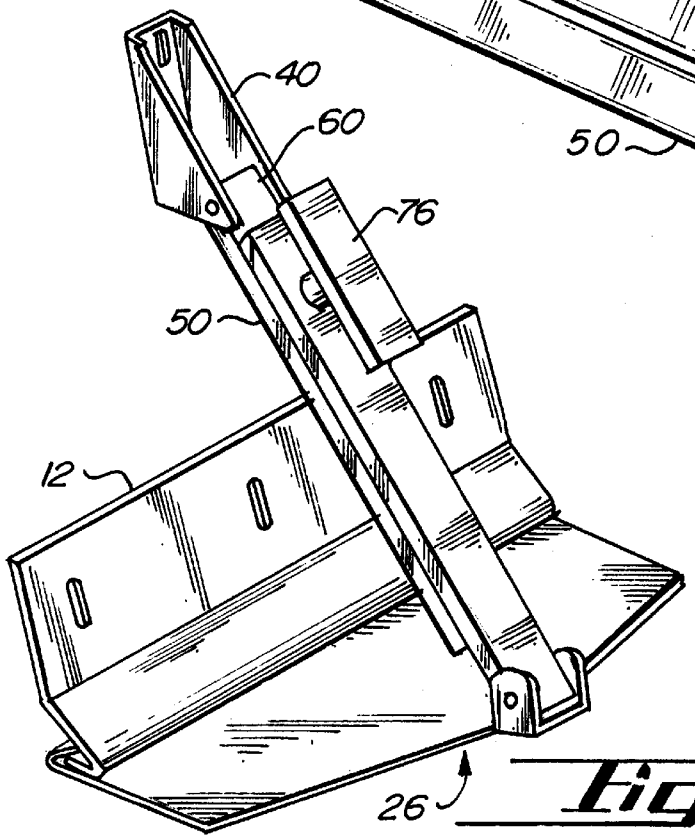
FIG. 4 is a perspective view of the manual trim tab of the present invention.
Figure 3:
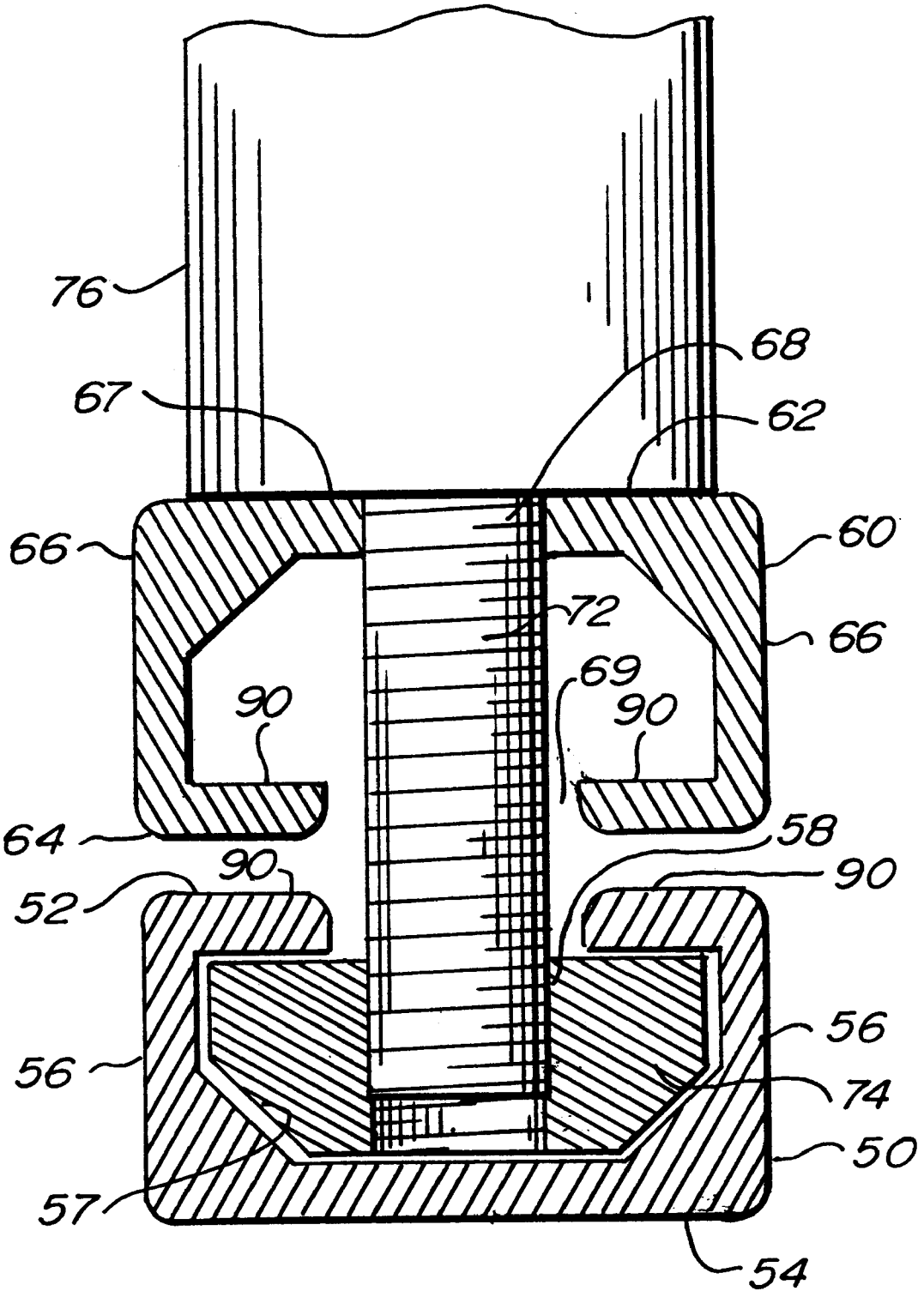

The manual trim tab of the present invention is generally designated in the Figures as reference numeral 10.

Thc manual trim tab 10 comprises a first bracket 12 adapted to be mounted on the transom T of a boat near the surface of the water W. The first bracket 12 further comprises a first portion 14 for mounting to the transom T; a second portion 16 extending downwardly from the first portion 14; and a third portion 18 extending forwardly from the second portion 16 and substantially parallel to the surface of the water W, the third portion 18 forming a shelf 20.

The first portion is attached to the transom T by fasteners 22 passing through openings 24.

Preferably, the second portion 16 extends downwardly from the first portion 14 at a slight angle, as shown in FIG. 1. This facilitates holding the trim plate to the third portion 18.

The manual trim tab 10 also comprises a trim plate 26 pivotally mounted on the first bracket 12. The trim plate 26 further comprises a tab portion 28 adapted to angularly penetrate the water's surface W, and a lip 30 formed at an angle to the tab portion 28 and adapted to pivotally engage the shelf 20.

This combination of shelf 20 and lip 30 provides an inexpensive way for the trim tab to pivot. Also, if the trim tab should hit a submerged obstacle, the trim plate and/or first bracket can be easily and inexpensively replaced.

Preferably, the trim plate 26 further comprises a pair of first ears 32 extending substantially perpendicular to the tab portion 28, the first ears 32 having first pivot holes 34 therethrough.

The manual trim tab 10 further comprises a second bracket 40 adapted to be mounted on the transom T above the first bracket 12. The second bracket 40 has a flat portion 42 for mounting to the transom T by fasteners 44. Preferably, the second bracket 40 has a pair of second ears 45 extending substantially perpendicular to the flat portion 42 and second pivot holes 46 therethrough.

The manual trim tab 10 also comprises a lower adjustment rod 50 mounted on the trim plate 26. Preferably, the lower adjustment rod engages the trim plate pivotally by a first pivot pin 52 passing through the first pivot holes 34 and lower adjustment rod pivot hole 53.

The manual trim tab 10 further comprises an upper adjustment rod 60 mounted on the second bracket 40. Preferably, the upper adjustment rod engages the second bracket 40 by a second pivot pin 62 passing through the second pivot holes 46 and upper adjustment rod pivot hole 63.

The upper adjustment rod 60 slidingly engages the lower adjustment rod 50. As the rods overlap to a greater or lesser extent, the trim plate 26 is tilted at varying angles to the water's surface W.

A locking means 70 is provided for preventing movement between the upper adjustment rod 60 and lower adjustment rod 50 once the desired trim is obtained. Preferably, the locking means is a screw 72 passing through the upper adjustment rod 60 and the lower adjustment rod 50 and a nut 74 engaging the screw 72. A handle 76 allows tensioning the screw 72 and nut 74. However, any tensioning mechanism that holds the upper adjustment rod 60 and lower adjustment rod 50 relative to one another could be used.

Optionally, a spacer 80 may be provided between the upper adjustment rod 60 and lower adjustment rod 50. The spacer can be made of any material, but preferably would be made of a material with a low coefficient of friction, thus optimizing the movement of the rods 60, 50 relative to one another. For example, the spacer 80 could be made of Teflon® or another plastic.

Preferably, the rods 60, 50 each have a pair of flanges 90 and the spacer 80 further comprises a pair of grooves 82 adapted to receive the flanges 90.

The upper adjustment rod 60 may preferably comprise a top wall 62, bottom wall 64, and side walls 66, with a hollow central core 67 and openings 68, 69 to the hollow central core 67 through the top wall 62 and bottom wall 64. The screw 72 passes through the openings 68, 69.

The lower adjustment rod 50 may preferably comprise a top wall 52, bottom wall 54, and side walls 56, with a hollow central core 57 and opening 58 to the hollow central core 57 through the top wall 52. The screw 72 passes through the opening 58. The nut 74 is retained in the hollow central core 57, as by flanges 90.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A manual trim tab for a power boat having a transom at the stern, comprising:

a) a first bracket adapted to be mounted to the boat's transom near the surface of the water, the first bracket further comprising a first portion for mounting to the transom, a second portion extending downwardly from the first portion, and a third portion having a shelf, the shelf being substantially perpendicular to the first portion;

b) a trim plate pivotally mounted on the first bracket by a lip pivotally engaging the shelf;

c) a second bracket adapted to be mounted to the boat's transom above the first bracket;

d) a lower adjustment rod pivotally mounted to the trim plate;

e) an upper adjustment rod pivotally mounted to the second bracket and slidingly engaging the lower adjustment rod, thereby varying the angle at which the trim plate meets the water's surface; and f) a locking means for preventing movement of the upper adjustment rod relative to the lower adjustment rod.

2. The manual trim tab of claim 1, wherein the locking means further comprises a screw passing through the upper adjustment rod and the lower adjustment rod, a nut engaging the screw, and a handle attached to the screw.

3. The manual trim tab of claim 1, further comprising a spacer between the upper adjustment rod and the lower adjustment rod.

4. The manual trim tab of claim 1, wherein the upper adjustment rod further comprises a top wall, a bottom wall, and side walls, a hollow central core, and openings to the hollow central core through the top wall and bottom wall, the screw passing through the openings.

5. The manual trim tab of claim 4, wherein the lower adjustment rod further comprises a top wall, a bottom wall, and side walls, a hollow central core, and openings to the hollow central core through the top wall and bottom wall, the screw passing through the openings, and wherein the screw is retained within the hollow central core.

6. A manual trim tab for a power boat having a transom at the stern, comprising:

a) a first bracket adapted to be mounted to the boat's transom near the surface of the water, the first bracket further comprising a first portion for mounting to the transom, a second portion extending downwardly from the first portion, and a third portion having a shelf, the shelf being substantially perpendicular to the first portion;

b) a trim plate pivotally mounted on the first bracket by a lip pivotally engaging the shelf;

c) a second bracket adapted to be mounted to the boat's transom above the first bracket;

d) a lower adjustment rod pivotally mounted to the trim plate;

e) an upper adjustment rod pivotally mounted to the second bracket and slidingly engaging the lower adjustment rod, thereby varying the angle at which the trim plate meets the water's surface;

f) a spacer between the upper adjustment rod and the lower adjustment rod, and wherein each of the upper adjustment rod and lower adjustment rod further comprises a pair of flanges and the spacer further comprises a pair of grooves adapted to receive the flanges of the upper adjustment rod and the lower adjustment rod; and g) a locking means for preventing movement of the upper adjustment rod relative to the lower adjustment rod.

7. The manual trim tab of claim 6, wherein the locking means further comprises a screw passing through the upper adjustment rod and the lower adjustment rod, a nut engaging the screw, and a handle attached to the screw.

8. The manual trim tab of claim 6, wherein the upper adjustment rod further comprises a top wall, a bottom wall, and side walls, a hollow central core, and openings to the hollow central core through the top wall and bottom wall, the screw passing through the openings.

9. The manual trim tab of claim 8, wherein the lower adjustment rod further comprises a top wall, a bottom wall, and side walls, a hollow central core, and openings to the hollow central core through the top wall and bottom wall, the screw passing through the openings, and wherein the screw is retained within the hollow central core.

10. A manual trim tab for a power boat having a transom at the stern, comprising:

a) a first bracket adapted to be mounted on the boat's transom near the surface of the water, the first bracket further comprising a first portion having openings therethrough for receiving fasteners for mounting the first bracket to the transom; a second portion extending downwardly from the first portion at an angle; and a third portion extending forwardly from the second portion and substantially parallel to the surface of the water, the third portion forming a shelf;

b) a trim plate pivotally mounted on the first bracket, the trim plate further comprising a tab portion adapted to angularly penetrate the water's surface, a lip formed at an angle to the tab portion and adapted to pivotally engage the shelf, and a pair of first ears extending substantially perpendicular to the tab portion, the first ears having first pivot holes extending therethrough;

c) a second bracket adapted to be mounted on the boat's transom above the first bracket, the second bracket having a flat portion having openings therethrough for receiving fasteners for mounting the second bracket to the transom and a pair of second cars extending substantially perpendicular to the flat portion, the second ears having second pivot holes therethrough;

d) a lower adjustment rod mounted to the trim plate by a first pivot pin passing through the lower adjustment rod and the first pivot holes;

e) an upper adjustment rod mounted to the second bracket by a second pivot pin passing through the upper adjustment rod and the second pivot holes;

f) the upper adjustment rod being slidingly engaged with the lower adjustment rod and thereby varying the angle of the tab portion relative to the water's surface; and g) a locking means for preventing movement of the upper adjustment rod relative to the lower adjustment rod.

11. The manual trim tab of claim 10, wherein the locking means further comprises a screw passing through the upper adjustment rod and lower adjustment rod, a nut engaging the screw, and a handle attached to the screw.

12. The manual trim tab of claim 10, further comprising a spacer between the upper adjustment rod and the lower adjustment rod.

13. The manual trim tab of claim 12, wherein each of the upper adjustment rod and lower adjustment rod further comprises a pair of flanges and the spacer further comprises a pair of grooves adapted to receive the flanges of the upper adjustment rod and the lower adjustment rod.

14. The manual trim tab of claim 11, wherein the upper adjustment rod further comprises a top wall, a bottom wall, and side walls, a hollow central core, and openings to the hollow central core through the top wall and bottom wall, the screw passing through the openings.

15. The manual trim tab of claim 14, wherein the lower adjustment rod further comprises a top wall, a bottom wall, and side walls, a hollow central core, and openings to the hollow central core through the top wall and bottom wall, the screw passing through the openings, and wherein the nut is retained within the hollow central core.

* * * * *